United States Patent [19]

Hauschopp et al.

[11] 4,205,882

[45] Jun. 3, 1980

[54] MINERAL MINING CONVEYOR WITH GUIDE CONNECTING FEATURE

[75] Inventors: Alois Hauschopp, Werne; Wolfgang Peters, Selm, both of Fed. Rep. of Germany

[73] Assignee: Gewerkschaft Eisenhutte Westfalia, Lunen, Fed. Rep. of Germany

[21] Appl. No.: 962,455

[22] Filed: Nov. 20, 1978

[30] Foreign Application Priority Data

Nov. 18, 1977 [DE] Fed. Rep. of Germany ..... 2751458

[51] Int. Cl.[2] ..... E21C 35/20

[52] U.S. Cl. ..... 299/43

[58] Field of Search ..... 299/32, 34, 43; 238/243, 256

[56] References Cited

U.S. PATENT DOCUMENTS

| | | | |
|---|---|---|---|
| 1,228,386 | 6/1917 | Ball | 238/256 X |
| 4,067,619 | 1/1978 | Peters et al. | 299/43 |

FOREIGN PATENT DOCUMENTS

| | | | |
|---|---|---|---|
| 1418955 | 12/1975 | United Kingdom | 299/43 |

*Primary Examiner*—Ernest R. Purser

*Attorney, Agent, or Firm*—Sughrue, Rothwell, Mion, Zinn and Macpeak

[57] ABSTRACT

A conveyor for use in mineral mining comprises a plurality of channel sections arranged end-to-end, and a guide disposed on one side of the channel sections for guiding a mining machine. The guide is constituted by a plurality of guide sections joined together by detachable connection means. Each guide section is attached to a respective channel section. The guide is provided with upper and lower channels separated by spacers, the channels receiving and guiding a chain for driving the mining machine. Each guide section is provided with a cover plate which is pivotally attached thereto for movement between a first position, in which it covers the guide channels, and a second position, in which the guide channels are accessible from said one side of the channel section. The detachable connection means associated with each adjacent pair of guide sections is constituted by recesses formed in adjacent spacers of that pair of guide sections, and a connector which mates with the recesses. The recesses are positioned to lie adjacent to the cover plates of that pair of guide sections when said cover plates are in that first position.

16 Claims, 3 Drawing Figures

MINERAL MINING CONVEYOR WITH GUIDE CONNECTING FEATURE

BACKGROUND OF THE INVENTION

This invention relates to a conveyor for use in mineral mining.

It is usual to construct a mineral mining conveyor from a plurality of channel sections joined end-to-end, a scaper-chain assembly being moved along these channel sections to convey won mineral, for example coal. The channel sections are usually interconnected by connectors which permit adjacent channel sections to angle slightly relative to one another whereby the conveyor can adapt itself to curved mine workings and irregularities in the mine floor. Such connectors must be strong enough to withstand the high loads which occur during mining operations, and this usually demands a robust construction. This type of conveyor is usually provided with a guide for a plough which is moved along the conveyor. Such a guide, which is also constituted by a plurality of sections joined end-to-end, is provided with channels which accommodate a chain used to drive the plough.

It is also known to connect the channel sections together by connecting the guide sections. However, the robust construction of the usual types of connector has resulted in them protruding into the guide channels or otherwise interfering with the guiding function. Moreover, difficulties arise in connecting the guide sections to the channel sections, particularly at their ends where the connectors are situated. A further disadvantage of these known constructions, is that the connectors are not readily accessible because of the presence of the guide. Known types of conveyor of this type are described in British Patent Specification No. 1,418,955 and German Offenlegungsschrift No. 24 60 176.

SUMMARY OF THE INVENTION

The aim of the invention is to provide an improved conveyor of the type mentioned above.

The present invention provides a conveyor for use in mineral mining, the conveyor comprising a plurality of channel sections arranged end-to-end, and a guide disposed on one side of the channel sections for guiding a mining machine, the guide being constituted by a plurality of guide sections joined together by detachable connection means, each guide section being attached to a respective channel section, the guide being provided with upper and lower channels separated by spacers, the channels serving, in use, to receive and guide a chain for driving the mining machine, each guide section being provided with a cover plate which is pivotally attached thereto for movement between a first position, in which it covers the guide channels, and a second position, in which the guide channels are accessible from said one side of the channel sections, wherein the detachable connection means associated with each adjacent pair of guide sections is constituted by recesses formed in adjacent spacers of that pair of guide sections, and a connector which mates with the recesses, the recesses being positioned to lie adjacent to the cover plates of that pair of guide sections when said cover plates are in their first positions.

This form of detachable connection means enables the guide sections (and hence the channel sections connected thereto) to be joined together in a tension-proof manner. Moreover, the channel sections are so joined together that adjacent sections can be angled slightly relative to one another so that the conveyor can adapt itself to curved mine workings and irregularities in the mine floor. Advantageously, the spacers are made of forged or cast metal.

Preferably, each guide section is constituted by an upstanding plate connected to a respective channel section, and two spacers connected to said plate adjacent each end thereof, the cover plate of that guide section being pivotally attached to said two spacers. The cover plate of each guide section is conveniently, pivotally attached to beading fixed to the two spacers of that guide section. Advantageously, an inclined floor-engaging slide plate is integrally formed with the upstanding plate of each guide section.

The connectors are secured in position by the cover plates when the latter are in their first (closed) positions. Thus, the connectors are readily accessible when the cover plates are pivoted to their second (open) positions. Preferably, the recesses are provided in the free end faces of the spacers. This permits simple and rapid connection of the channel sections.

Advantageously, each of the recesses is of C-shaped formation, and each connector is in the form of a closed oval loop. In this case, a spigot may be provided within each recess, the spigots being formed integrally with their associated spacers and extending, in use, into a respective connector. Instead of oval-shaped loops or links, other forms of connector (for example bolts) could be used, and these could also be introduced from said one side of the conveyor.

Preferably, each cover plate is provided with a welded-in end piece which covers the recess in the associated spacer when that cover plate is in its first position. Each cover plate may be pivotally attached to said two spacers by means of pivot pins provided on said end-pieces.

The spacers may be provided with holes for receiving bolts which connect the guide sections to the channel sections, the holes in the spacers being positioned adjacent to the respective recesses. Advantageously, said bolts also connect the spacers to the upstanding plates. Preferably, each of said bolts carries a securing member for holding the adjacent connector in place in its recess when the associated cover plate is in its second position.

BRIEF DESCRIPTION OF THE DRAWINGS

A mineral mine conveyor constructed in accordance with the invention will now be described, by way of example, with reference to the accompanying drawings, in which.

DESCRIPTION OF PREFERRED EMBODIMENTS

Figure 1:
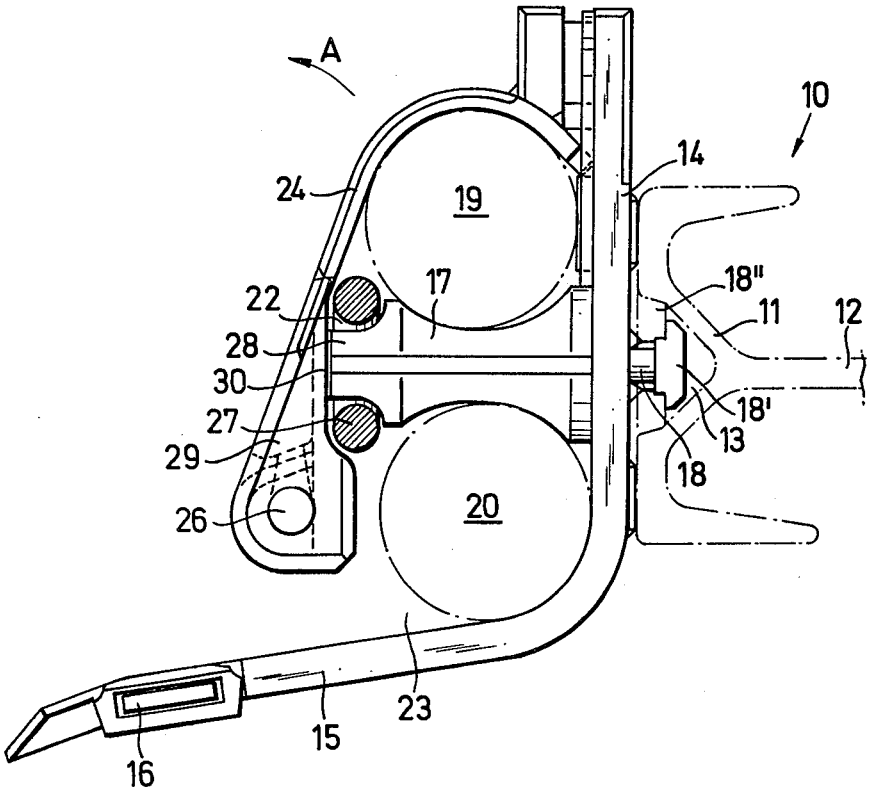
FIG. 1 is a diagrammatic, part-sectional end view of the conveyor.

Referring to the drawings, the conveyor is composed, in known manner, of a plurality of channel sections (or pans) 10 joined end-to-end. Each channel section 10 is formed with two sigma-section side walls 11 (only one of which can be seen in FIG. 1) connected together by means of a welded-in floor plate 12. The sigma-section formation of each of the side walls 11 results in the formation of an external, central V-shaped recess 13. A scraper-chain assembly (not shown) circulates within the channel section 10 in known manner.

A guide is provided on the mineral face side walls 11 of the channel sections 10, the guide serving to guide a mining machine, such as a plough, for movement along the conveyor. The guide is constituted by a plurality of guide sections, each of which is connected to a corresponding channel section 10. Each guide section is substantialy the same length as its respective channel section 10. Each guide section has an upstanding plate 14, which is attached to the adjacent side wall 11 of the respective channel section 10, and an inclined floor plate 15 which is integrally formed with the plate 14. The floor plates 15 support the mining machine, and their end edges rest on the mine floor. Adjacent floor plates 15 are connected together by means of spring shackles 16.

Spacers 17 are connected, by means of bolts 18, to the plate 14 of each guide section, there being a respective spacer at each end of the plate 14, and there may also be spacers positioned part way along the plate. The bolts 18 may also be utilised to fasten the plates 14 to the side walls 11 of the corresponding channel sections 10. The heads 18' of the bolts 18 are housed within the recesses 13 and bear against welded-in retaining members 18". Each of the spacers 17 is much shorter than the remaining parts 14,15 of the associated guide section. Thus, each channel section 10 is connected to a corresponding plate 14,15, which has an overall length corresponding to that of the channel section, and to at least two corresponding spacers which are correspondingly shorter. The spacers 17 divide the interior of the guide into two guide channels 19 and 20 which receive a chain (not shown) used to drive the mining machine along the conveyor. The upper channel 19 receives the return run of the chain, and the lower channel 20 receives the drive run of the chain. The mining machine has an attachment (not shown) which projects through an opening 23 in the lower channel 20 to connect with the drive run of the chain.

The two channels 19 and 20 are protected by means of cover plates 24, each of which is associated with a respective one of the guide sections. Each cover plate 24 is of generally ramp formation, and is pivoted to beading 25 by means of pivot pins 26, the beading being secured to the spacers 17 of that guide section. Each cover plate 24 can, therefore, be swung about its pivot pins 26 towards the mine face (that is to say in the direction of the arrow A) so that the channels 19 and 20 are accessible. In the closed position, the cover plates 24 bear against the spacers 17. The cover plates 24 are detachably secured in the closed position by means of bolts 21 (see FIG. 2).

Figure 2:
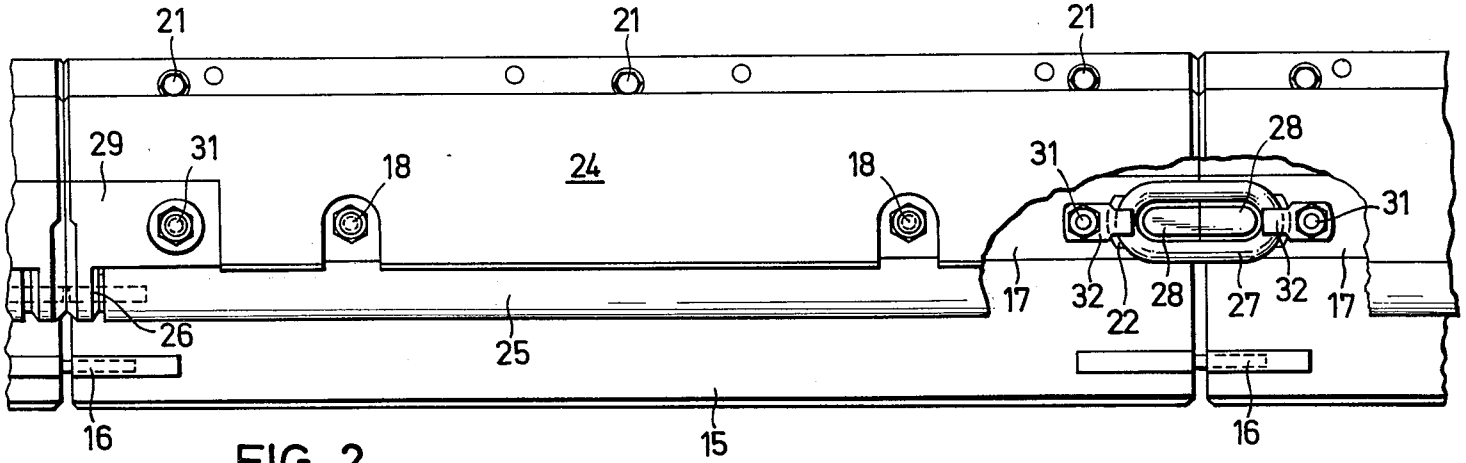
FIG. 2 is a partially cut-away side elevation, seen from the mineral face, of the conveyor of FIG. 1.
Figure 3:
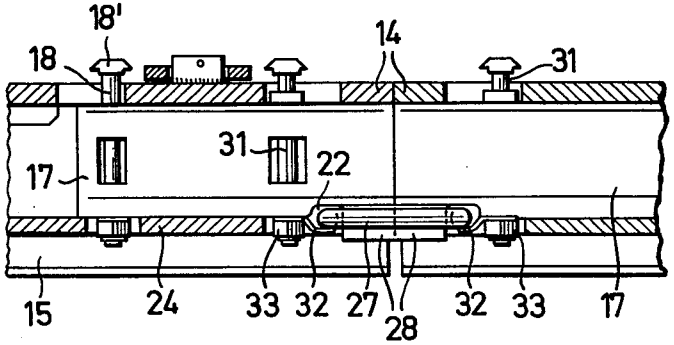
FIG. 3 is a horizontal cross-section of the adjacent parts of two adjacent channel sections of the conveyor.

Adjacent channel sections 10 are connected together by connecting the guide sections attached thereto (see FIGS. 2 and 3). The mineral-face side edges of the spacers 17 (that is to say the edges adjacent to the cover plages 24) are provided, at their guide section ends, with pockets 22 for receiving connectors 27. The connectors are of looped or chain link formation, and the pockets 22 are of complementary configuration. The spacers 17 are provided at their ends with spigots 28, the two adjacent spigots of each adjacent pair of spacers being surrounded, in use, by a respective connector 27. The spigots 28 are integrally formed with the spacers 17 but have a smaller cross-section to enable them to locate within the connectors. In this way, adjacent spacers 17 of adjacent guide sections are interconnected in a tension-proof manner. Consequently, the channel sections 10 are also interconnected. Moreover, the connectors 27 permit a certain degree of mobility between the channel sections 10, and so enable the conveyor to adapt itself to irregularities in the course of the mine working.

As the connectors 27 are situated at the outer free ends of the spacers 17, they lie immediately behind the cover plates 24, and so are readily accessible when the cover plates are swung open. At each of its two ends, each cover plate 24 is provided with a welded-on end piece 29 which supports one of the pivot pins 26. In the closed position of the cover plates 24, the connectors 27 are held in position by the inner faces 30 of these end pieces 29, and so cannot fall off the spigots 28. The end pieces 29 are contoured (see FIG. 1) so that, when the cover plates 24 are closed, they complement the rounded shape of the connectors 27.

Adjacent to that of its ends provided with the spigot 28, each spacer 17 has a hole for receiving a bolt 31. A clip 32, or other securing element, is fitted to the nut 33 of each of the bolts 31, the clips 32 overlying the connectors 27 to hold them in place over the spigots 28 when the cover plates 24 are swung open. The bolts 31 also serve to connect the spacers 17 to the plates 14, and the plates 14 to the side walls of the channel sections 10. Thus, the bolts 31 also supplement the action of the bolts 18. The clips 32 are not essential, and can be omitted.

We claim:

1. A conveyor for use in mineral mining, the conveyor comprising a plurality of channel sections arranged end-to-end, and a guide disposed on one side of the channel sections for guiding a mining machine, the guide being constituted by a plurality of guide sections joined together by detachable connection means, each guide section being attached to a respective channel section, the guide being provided with upper and lower channels separated by spacers, the channels receiving and guiding a chain for driving the mining machine, each guide section being provided with a cover plate which is pivotally attached thereto for movement between a first position, in which it covers the guide channels, and a second position, in which the guide channels are accessible from said one side of the channel sections, wherein the detachable connection means associated with each adjacent pair of guide sections is constituted by recesses formed in adjacent spacers of each pair of guide sections, and a connector which mates with the recesses, said recesses being positioned to lie adjacent to the cover plates of that pair of guide sections when said cover plates are in said first position, said recesses being positioned to facilitate the access of said connectors when said cover plates are in said second position.

2. A conveyor according to claim 1, wherein each guide section is constituted by an upstanding plate connected to a respective channel section, and two spacers connected to said plate adjacent each end thereof, the cover plate of that guide section being pivotally attached to said two spacers.

3. A conveyor according to claim 2, wherein the cover plate of each guide section is pivotally attached to beading fixed to the two spacers of that guide section.

4. A conveyor according to claim 2, wherein an inclined, floor-engaging, slide plate is integrally formed with the upstanding plate of each guide section.

5. A conveyor according to claim 1, wherein the recesses are provided in the free end faces of the spacers.

6. A conveyor according to claim 5, wherein each of the recesses is of C-shaped formation, and each connector is in the form of a closed oval loop.

7. A conveyor according to claim 6, wherein a spigot is provided within each recess, the spigots being formed integrally with their associated spacers and extending into a respective connector.

8. A conveyor according to claim 2, wherein each cover plate is provided with a welded-in end piece which covers the recess in the associated spacer when that cover plate is in its first position.

9. A conveyor according to claim 8, wherein each cover plate is pivotally attached to said two spacers by means of pivot pins provided on said end-pieces.

10. A conveyor according to claim 2, wherein the spacers are provided with holes for receiving bolts which connect the guide sections to the channel sections, the holes in the spacers being positioned adjacent to the respective recesses.

11. A conveyor according to claim 10, wherein said bolts also connect the spacers to the upstanding plates.

12. A conveyor according to claim 11, wherein each of said bolts carries a securing member for holding the adjacent connector in place in its recess when the associated cover plate is in its second position.

13. A conveyor according to claim 1, wherein each cover plate is pivotally attached to its guide section about an axis which lies below the recesses forming part of the connection means of that guide section.

14. A mineral mining installation comprising a conveyor and a guide attached to one side of the conveyor, the conveyor being constituted by a plurality of channel sections, and the guide being constituted by a plurality of guide sections, the guide sections being joined together by detachable connection means in such a manner as to join the channel sections together, wherein the detachable connection means associated with a given pair of adjacent guide sections is positioned on that side of said pair of guide sections remote from the associated channel sections to thereby facilitate access to said detachable connection means, and wherein said detachable connection means is constituted by recesses formed in the guide sections and a connector which mates with the recesses.

15. In a conveyor for use in mineral mining, the conveyor comprising a plurality of channel sections arranged end-to-end, and a guide disposed on one side of the channel sections for guiding a mining machine, the guide being constituted by a plurality of guide sections joined together by detachable connection means, each guide section being attached to a respective channel section, the guide being provided with upper and lower channels separated by spacers, the channels receiving and guiding a chain for driving the mining machine, each guide section being provided with a cover plate which is pivotally attached thereto for movement between a first position, in which it covers the guide channels, and a second position, in which the guide channels are accessible from one side of the channel sections, the improvements comprising constituting the detachable connection means associated with each adjacent pair of guide sections by recesses formed in adjacent spacers of that pair of guide sections, and a connector which mates with the recesses, said recesses being positioned to lie adjacent to the cover plates of that pair of guide sections when said cover plates are in said first position, said recesses being positioned to facilitate the access of said connectors when said cover plates are in said second position.

16. In a mineral mining installation comprising a conveyor and a guide attached to one side of the conveyor, the conveyor being constituted by a plurality of channel sections, and the guide being constituted by a plurality of guide sections, the guide sections being joined together by detachable connection means in such a manner as to join the channel sections together, the improvement comprising positioning the detachable connection means associated with a given pair of adjacent guide sections on that side of said pair of guide sections remote from the associated channel sections to thereby facilitate access to said detachable connection means, and constituting said detachable connection means by recesses formed in the guide sections and a connector which mates with the recesses.

* * * * *